US006607144B1

(12) United States Patent
Yen

(10) Patent No.: US 6,607,144 B1
(45) Date of Patent: Aug. 19, 2003

(54) AQUAVISION FOUNTAINS POT

(76) Inventor: Jen Yen Yen, No. 22-1, Lane 3, Haochin Rd., Nanhsin Tsun, Yenpu Hsiang, Changhua County (TW)

( * ) Notice: Subject to any disclaimer, the term of this patent is extended or adjusted under 35 U.S.C. 154(b) by 0 days.

(21) Appl. No.: 10/351,549

(22) Filed: Jan. 27, 2003

(51) Int. Cl.[7] ..... B05B 17/08

(52) U.S. Cl. ..... 239/17; 239/16; 239/18; 239/20; 239/23; 239/211; 239/289

(58) Field of Search ..... 239/16, 17, 18, 239/19, 20, 23, 289, 211

(56) References Cited

U.S. PATENT DOCUMENTS 2,974,871 A * 3/1961 Naythons ..... 239/17
3,702,172 A * 11/1972 Hawkins ..... 239/18
5,127,366 A * 7/1992 Kim ..... 119/246
6,149,070 A * 11/2000 Hones ..... 239/17
6,505,782 B1 * 1/2003 Yen ..... 239/17

* cited by examiner

*Primary Examiner*—Robin O. Evans
(74) *Attorney, Agent, or Firm*—Rosenberg, Klein & Lee

(57) ABSTRACT

An aquavision fountains pot is constructed to include a pot body, a nozzle holder fastened to the pot body at the top, the nozzle holder defining a bottom water chamber and a light chamber and sealed with a bottom sealing plate carrying a set of LEDS, a water pump adapted to pump water from the pot body to the water chamber and to further force water out of jet nozzles of the nozzle holder when the LEDs turned on to emit light, a meshed dashboard fastened to the nozzle holder and adapted to guide falling water to the inside of the pot body.

3 Claims, 7 Drawing Sheets

AQUAVISION FOUNTAINS POT

BACKGROUND OF THE INVENTION

1. Field of the Invention

The present invention relates to an aquarium motion indoor decorative item and, more specifically, to an aquavision fountains pot, which produces a lighting effect when ejecting jets of water to show an artificial fountain.

2. Description of the Related Art

FIGS. 1 and 2 show an aquavision fountains pot invented by the present inventor. This structure of aquavision fountains pot is comprised of a pot body 1 with a wire hole 2, a face panel 10, an upper seal plate 6 with bottom tubes 7, a bottom sealing plate 30, hoses 5, and a plurality of water pumps 4. The face panel 10 comprises an annular flange 11 downwardly protruded from the bottom sidewall thereof, a plurality of annular ribs 12 of different diameters provided at the bottom sidewall and concentrically disposed within the annular flange 11, a plurality of jet holes 130 cut through the bottom sidewall in communication with the annular waterways defined in between the annular ribs 12 within the annular flange 11, a plurality of jet nozzles 13 respectively upwardly extended from the top sidewall thereof and connected to the jet holes 130 to receive water from the jet holes 130, a plurality water return holes 14 disposed around the periphery outside the annular flange 32, and a plurality of dashboards 15 respectively disposed around the jet nozzles 13 and adapted for buffering fallen water. This structure of aquavision fountains pot is functional, however has drawbacks as follows:

1. The structure of the face panel 10 is complicated.
2. Because multiple waterways are defined in between the annular ribs 12 within the annular flange 11, multiple water pumps are required.
3. Dashboards 15 cannot effectively buffer falling water to prevent falling water from splashing.
4. Because water flows back to the pot body when the aquavision fountains pot turned off, it takes much time to pump water from the pot body to the waterways in the face panel.
5. It does not produce a lighting effect.

SUMMARY OF THE INVENTION

The present invention has been accomplished under the circumstances in view. It is one object of the present invention to provide an aquavision fountains pot, which produces a lighting effect when ejecting water to show an artificial fountain. It is another object of the present invention to provide an aquavision fountains pot, which has a simple structure. According to one aspect of the present invention, the aquavision fountains pot comprises a pot body, a nozzle holder fastened to the pot body at the top, the nozzle holder defining a bottom water chamber and a light chamber and sealed with a bottom sealing plate carrying a set of LEDS, a water pump adapted to pump water from the pot body to the water chamber and to further force water out of jet nozzles of the nozzle holder when the LEDs turned on to emit light, a meshed dashboard fastened to the nozzle holder and adapted to guide falling water to the inside of the pot body. According to another aspect of the present invention, a one-way valve is provided to prevent reverse flow of water from the water chamber to the pot body through the water pump.

DETAILED DESCRIPTION OF THE PREFERRED EMBODIMENT

Figure 1:
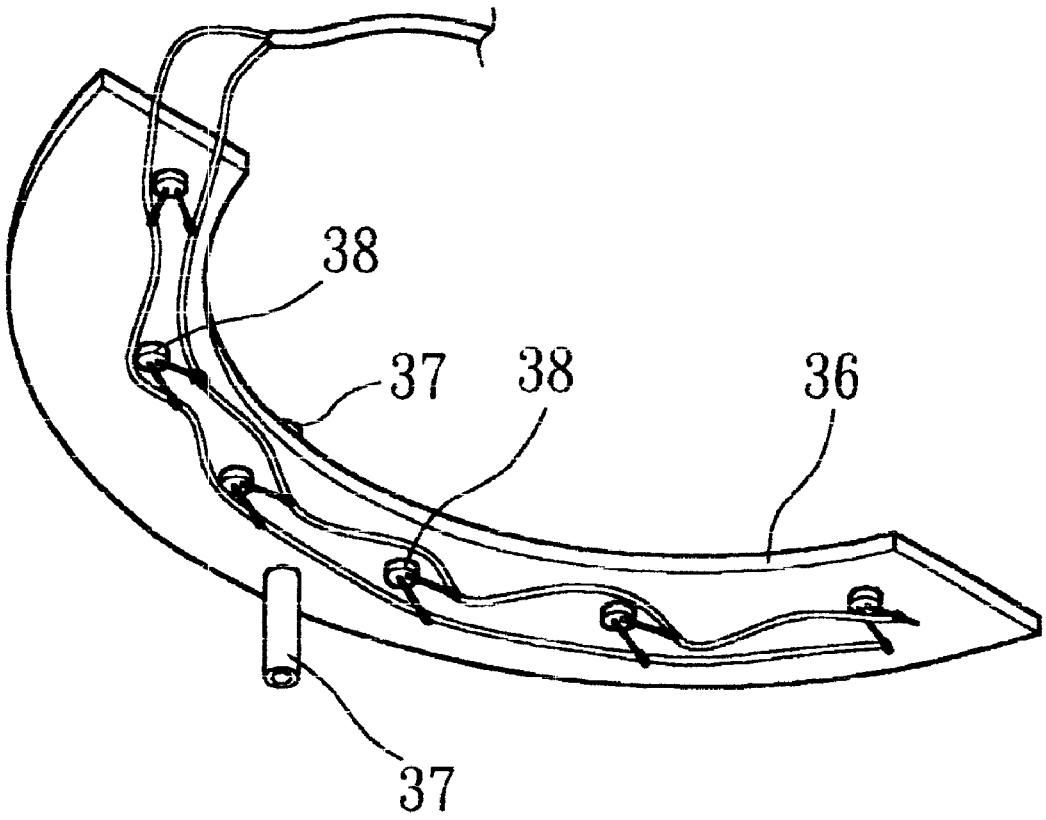
FIG. 1 is an exploded view of an aquavision fountains pot constructed according to the prior art.
Figure 2:
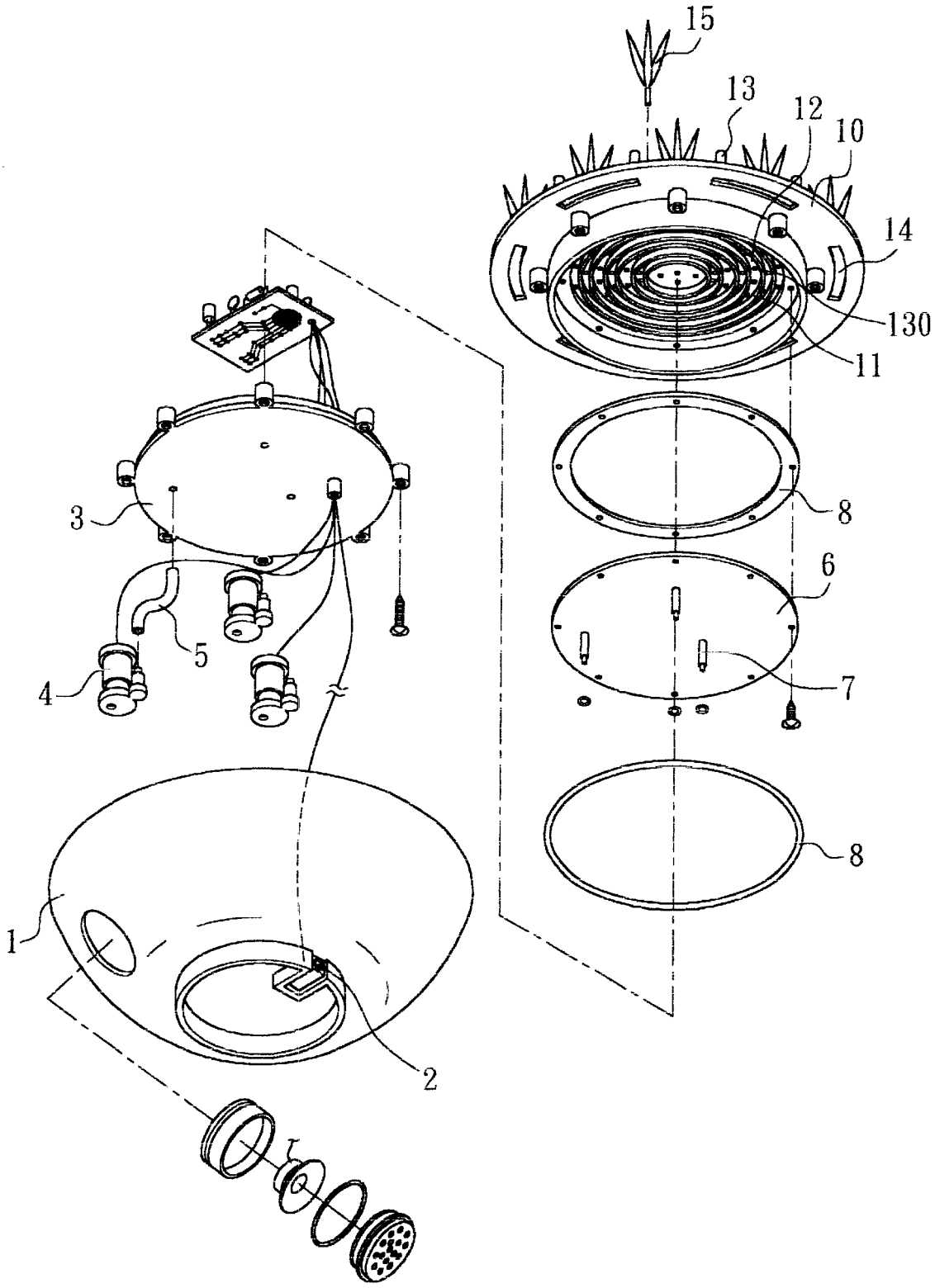
FIG. 2 is a sectional assembly view of the aquavision fountains pot according to the prior art.
Figure 3:
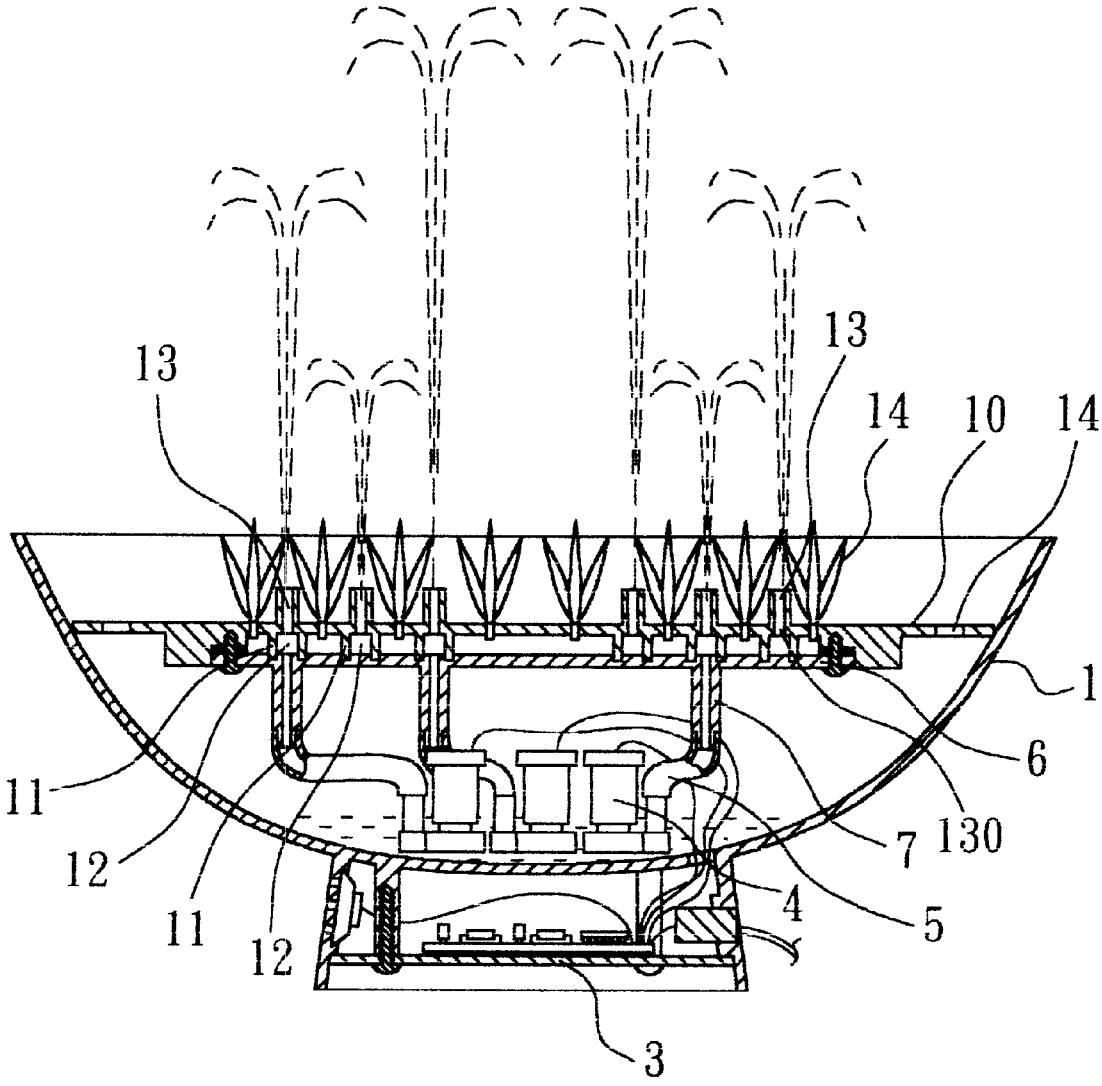
FIG. 3 is an exploded view of an aquavision fountains pot constructed according to the present invention.
Figure 4:
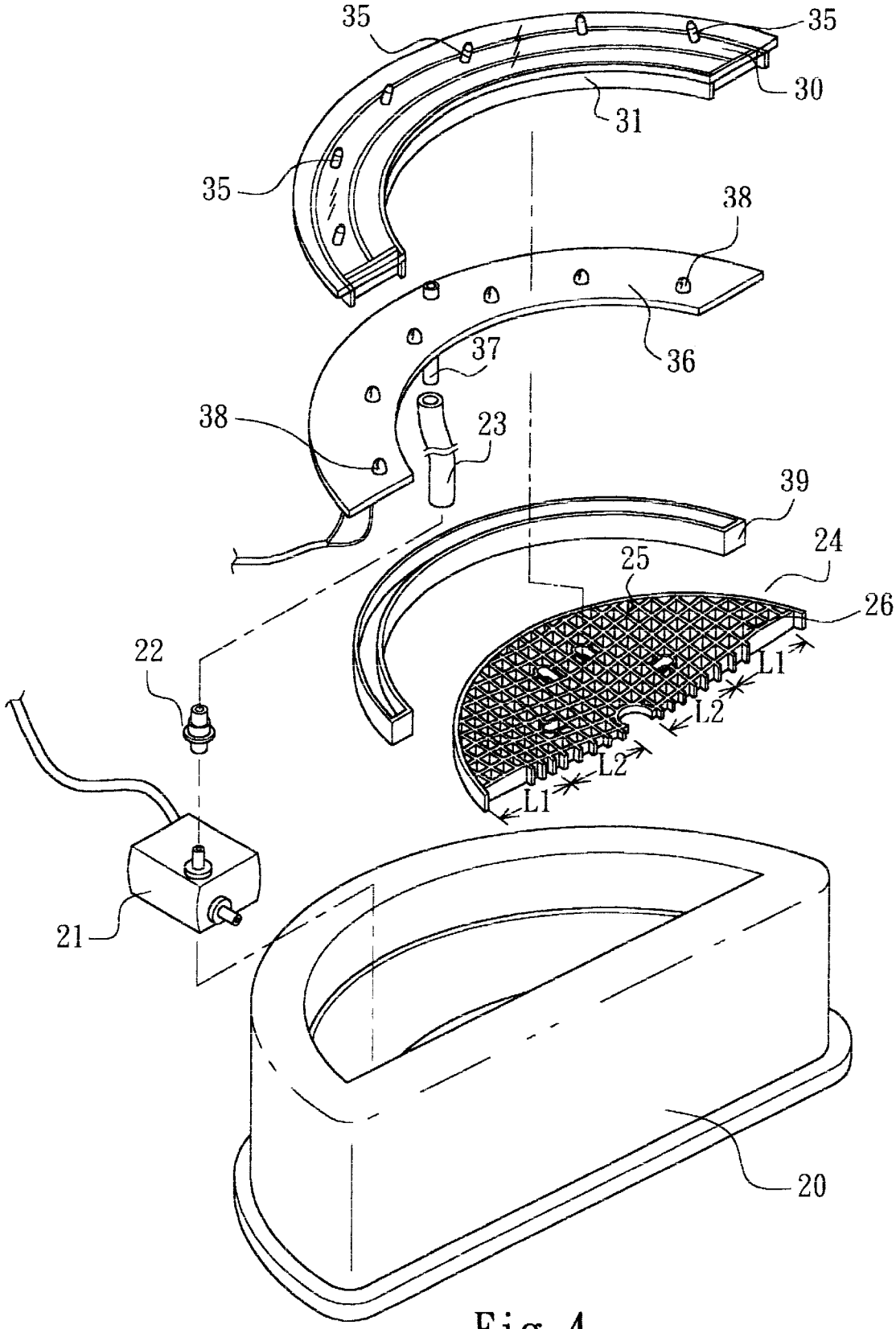
FIG. 4 is an oblique bottom view of the nozzle holder for the aquavision fountains pot according to the present invention.
Figure 5:
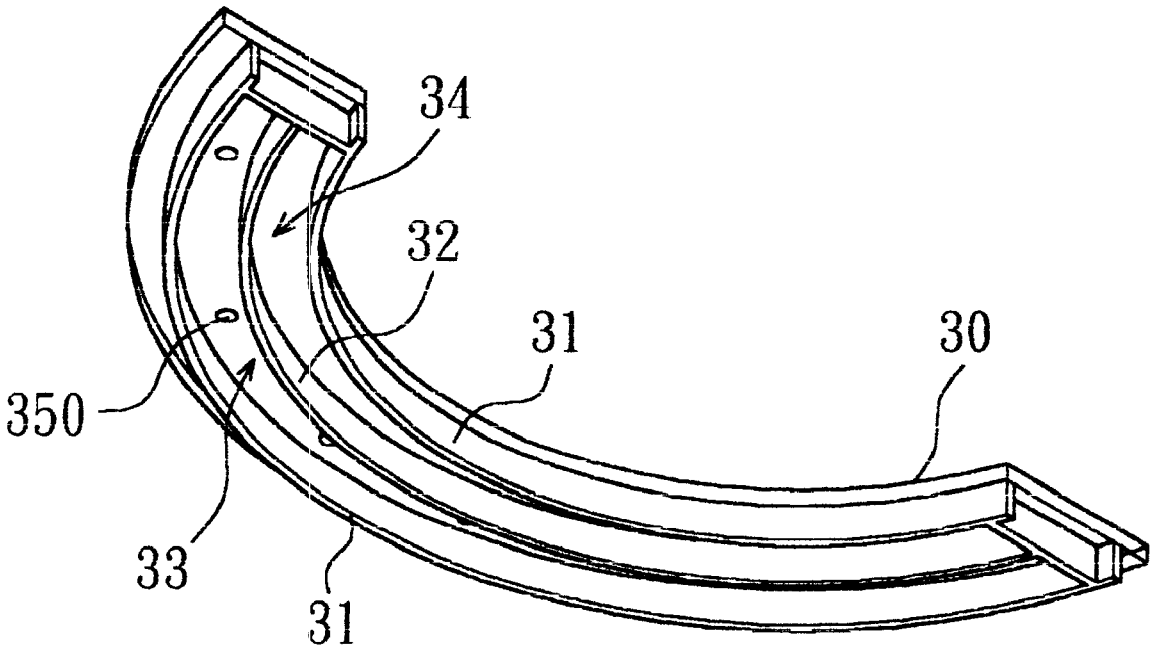
FIG. 5 is an oblique bottom view of the bottom sealing plate for the aquavision fountains pot according to the present invention.

Referring to FIGS. from 3 through 6, an aquavision fountains pot in accordance with the present invention is generally comprised of a pot body 10, a nozzle holder 30 that admits light, a bottom sealing plate 36, a sealing shell 39, a meshed dash board 24, a connector 22, a hose 23, and a water pump 21.

The pot body 10 is a semicircular container.

The nozzle holder 30 is an arched member injection-molded from plastics and fastened to the top side of the pot body 20, having two downwardly protruded peripheral walls 31, a partition wall 32 separating the holding space between the peripheral walls 31 into a water chamber 33 and a light chamber 34, a plurality of water holes 350 in communication with the water chamber 33, and a plurality of sloping jet nozzles 35 respectively connected to the water holes 350 and obliquely suspended at the top side for output of water from the water chamber 33.

The bottom sealing plate 36 is an arched member fastened to the nozzle holder 30 to seal the water chamber 33 and the light chamber 34, having a water guide tube 37 connected to the water pump 21 through the connector 22 and the hose 23, and a set of LEDs (light emitting diodes) 38 respectively suspended in the light chamber 34.

The sealing shell 39 is fixedly fastened to the bottom sealing plate 36 to seal the circuits of the LEDs 38 against water.

The meshed dashboard 24 is fastened to the inner side of the nozzle holder 30, having intersected ribs 25 and open spaces 26. The top side of the meshed dashboard 24 curves inwards from the border area L1 toward the center area L2. This inward curving design prevents splashing of falling water, enabling falling water to be quickly guided to the pot body 20.

Figure 6A:
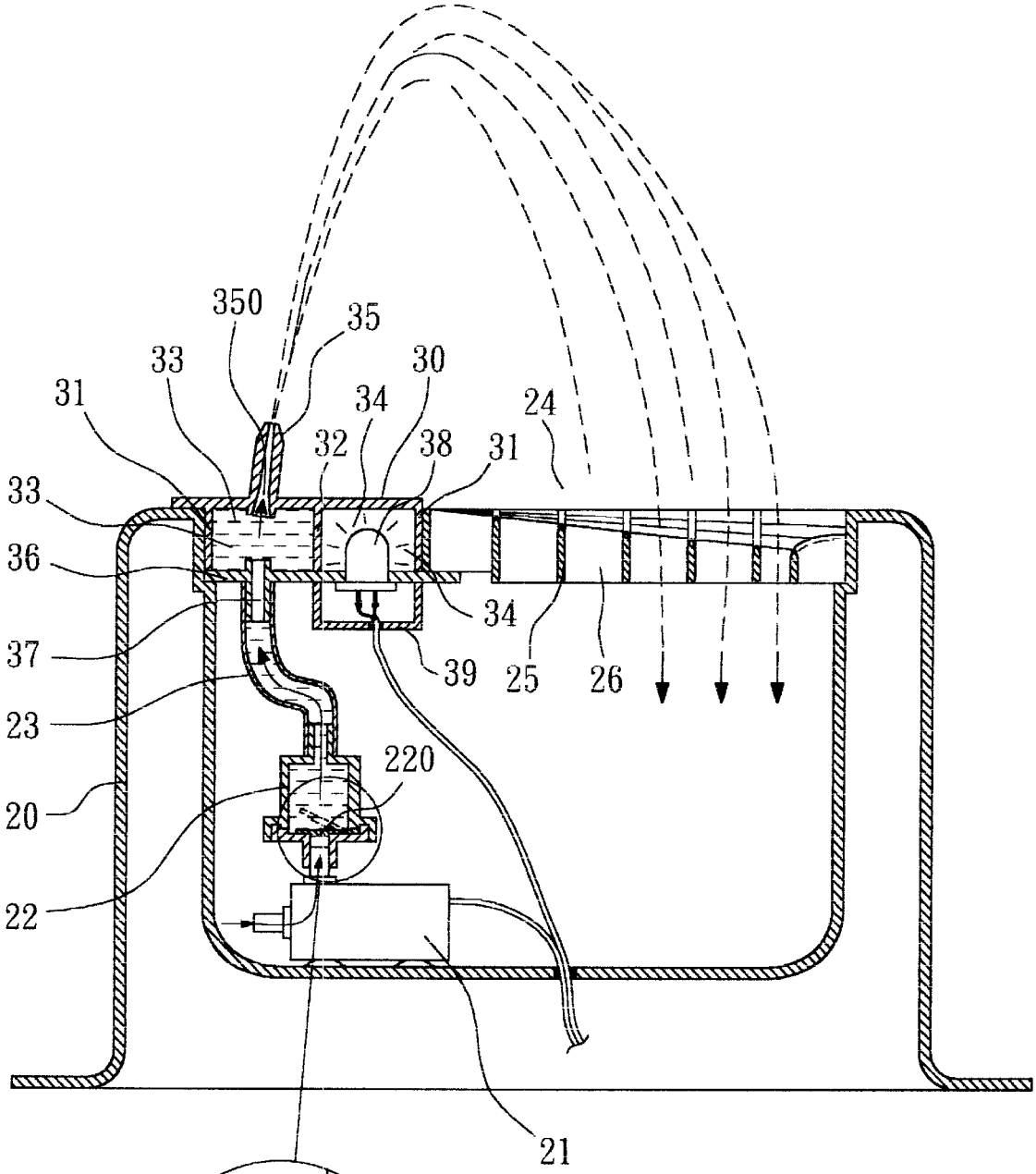
FIG. 6A is a schematic sectional view of the present invention, showing the operation of the aquavision fountains pot.
Figure 6B:
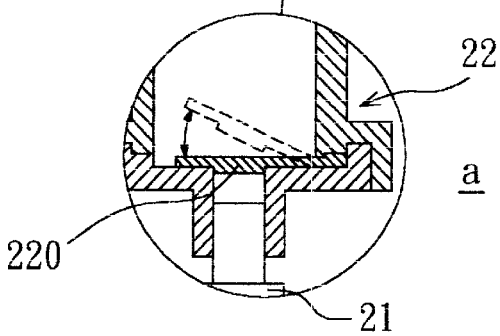
FIG. 6B is an enlarged view of a part of FIG. 6A.

The connector 22 is connected between the hose 23 and the water pump 21, having a valve flap 220 (see FIG. 6B) adapted to prohibit return of water, i.e., the valve flap 220 enables the water pump 21 to pump water from the pot body 20 to the water chamber 33 in the nozzle holder 30 and, prohibits return of water from the water chamber 33 to the pot body 20.

Referring to FIG. 6A again, when the water pump 21 started to pump water from the pot body 20 to the water chamber 33. When the water chamber 33 filled up with water, continuous pumping action of the water pump 21 causes water to be forced out of the jet nozzles 35. At the same time, the LEDs 38 are turned on to emit light. Further falling water passes through the open spaces 26 of the meshed dashboard 24 to the inside of the pot body 20 for recycling.

Figure 7:
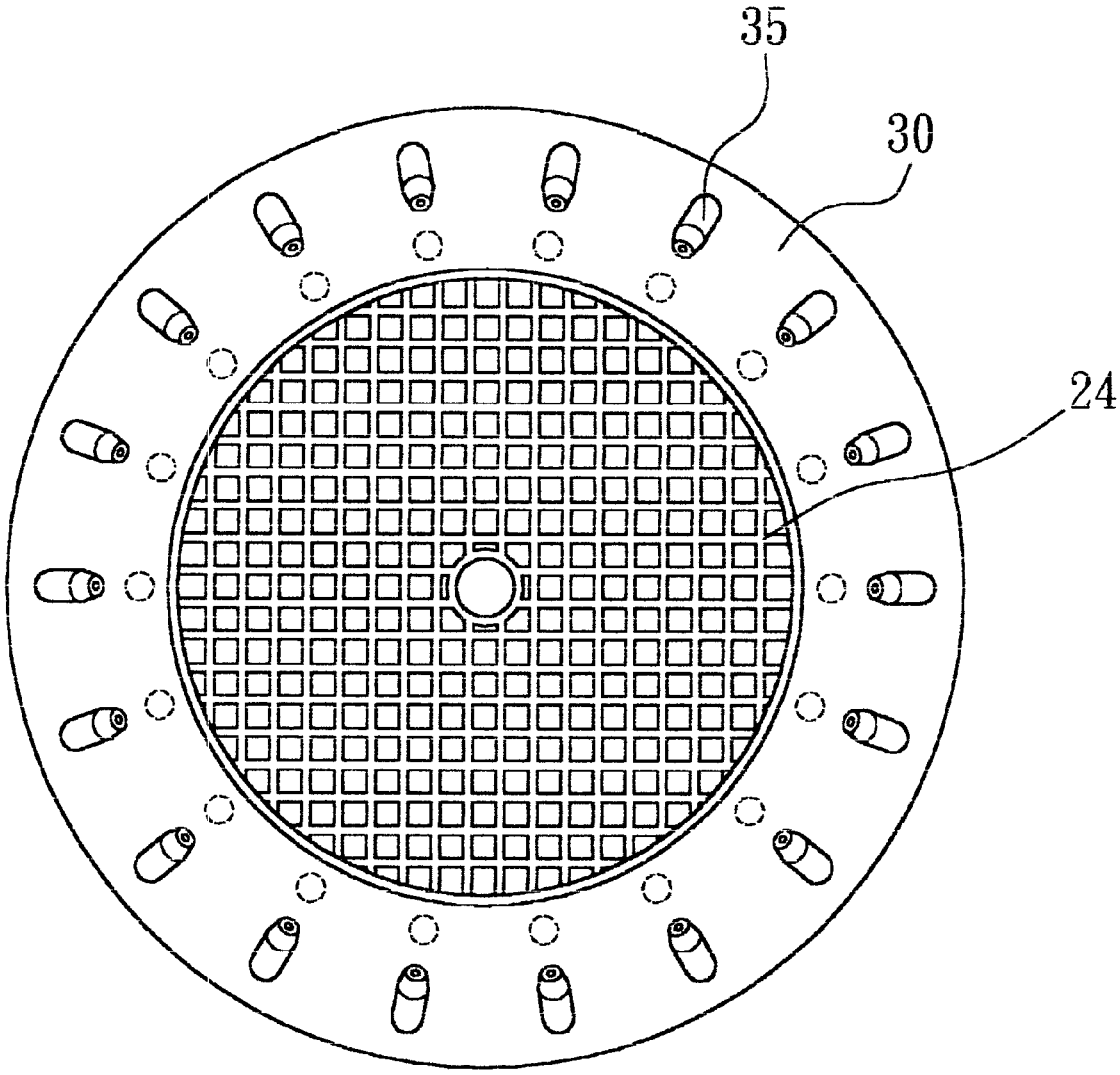
FIG. 7 is a plain view of an alternate form of the aquavision fountains pot according to the present invention.

FIG. 7 shows an alternate form of the present invention. According to this alternate form, the nozzle holder 30 has an annular member, and the meshed dashboard 24 is a circular board.

A prototype of aquavision fountains pot has been constructed with the features of the annexed drawings of FIGS. 3~7. The aquavision fountains pot functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. An aquavision fountain pot comprising:

a pot body holding an amount of water;

a nozzle holder molded from plastics that admit light and fastened to a top side of said pot body, said nozzle holder comprising a water chamber and a light chamber defined in a bottom side thereof, a plurality of water holes in communication with said water chamber, and a plurality of sloping jet nozzles respectively connected to said water holes and obliquely suspended at a top side thereof for output of water from said water chamber;

a bottom sealing plate fastened to said nozzle holder to seal said water chamber and said light chamber, said bottom sealing plate having a water guide tube adapted to guide water from said pot body to said water chamber and a set of light emitting diodes respectively suspended in said light chamber;

a sealing shell fixedly fastened to said bottom sealing plate to seal circuits of said light emitting diodes against water;

a meshed dashboard fastened to an inner side of said nozzle holder, said meshed dashboard having a top side curved inwards from the border thereof toward the center area thereof, intersected ribs, and open spaces for guiding falling water outputted from said jet nozzles to the inside of said pot body;

a water pump adapted to pump water from said pot body to said water chamber through said water guide tube;

a hose connected between said water guide tube and said water pump; and a connector connected between said hose and said water pump, said connector having one-way valve means for controlling the flowing direction of water from said water pump to said water chamber through said hose and said water guide tube.

2. The aquavision fountain pot as claimed in claim 1, wherein said nozzle holder, said bottom sealing plate and said sealing shell are smoothly arched, and said meshed dashboard is a meshed semicircular board.

3. The aquavision fountain pot as claimed in claim 1, wherein said nozzle holder, said bottom sealing plate and said sealing shell are annular members, and said meshed dashboard is a circular board.

* * * * *